US005077996A

United States Patent [19]

Lien

[11] Patent Number: 5,077,996

[45] Date of Patent: Jan. 7, 1992

[54] STRUCTURE OF COMBINED LOCK DEVICE

[76] Inventor: Jack Lien, No. 30, Yen Chi Str., Kaohsiung City, Taiwan

[21] Appl. No.: 691,971

[22] Filed: Apr. 26, 1991

[51] Int. Cl.[5] ..... E05B 17/18; E05B 37/00

[52] U.S. Cl. ..... 70/284; 70/156; 70/333 A; 70/423; 70/455; 292/346

[58] Field of Search ..... 70/284, 285, 21, 333 A, 70/DIG. 71, DIG. 63, 455, 423–428, 156; 292/346

[56] References Cited

U.S. PATENT DOCUMENTS

| | | | |
|---|---|---|---|
| 714,458 | 11/1902 | Dalton et al. | 70/284 |
| 845,019 | 2/1907 | Voight | 70/427 |
| 1,437,561 | 12/1922 | Shively | 70/284 |
| 2,834,195 | 5/1958 | Stackhouse | 70/423 |
| 3,948,550 | 4/1976 | Vigluicci et al. | 292/346 X |
| 4,354,367 | 10/1982 | Wahl | 70/455 X |
| 4,793,165 | 12/1988 | Rochman | 70/284 |

*Primary Examiner*—Lloyd A. Gall
*Attorney, Agent, or Firm*—Bacon & Thomas

[57] ABSTRACT

A combined lock device comprised of a key lock linked up with at least one combination lock. The key lock can be unlocked by a key only when the combination lock is unlocked. A division plate is mounted on the lock device to alternatively conceal the key lock and the at least one combination lock, so as to prohibit the key lock and the at least one combination lock from being simultaneously exposed to thieves' eyes. The lock bolt which is driven by the key to fasten a door, strongbox, etc. has a notch on the slope of the front end thereof to protect against insertion of a pry.

3 Claims, 3 Drawing Sheets

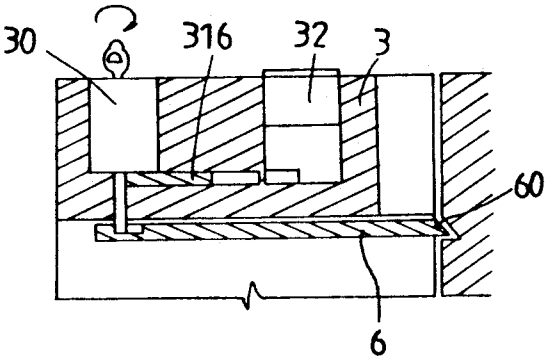
FIG. 2
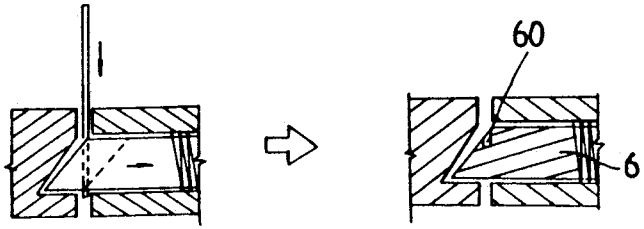
FIG. 4
FIG. 3
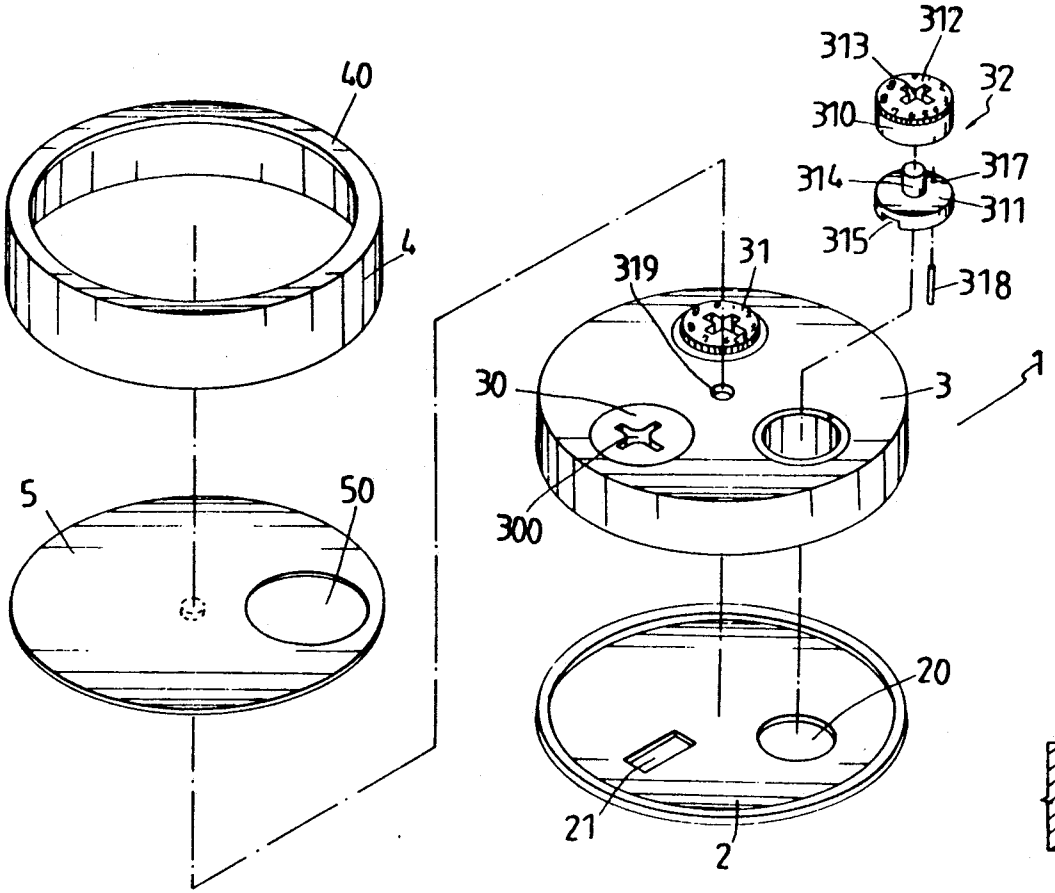
FIG. 1

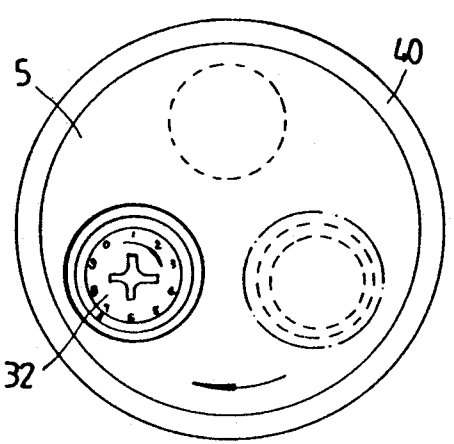
FIG. 5
FIG. 6
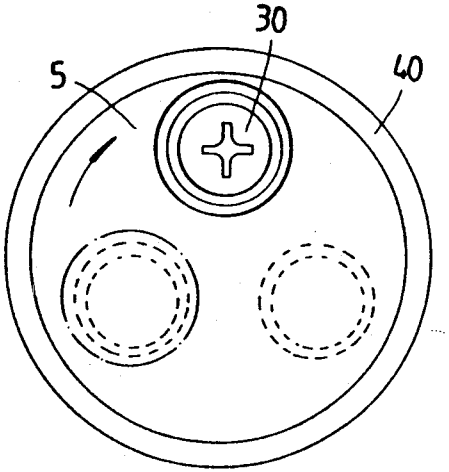
FIG. 7
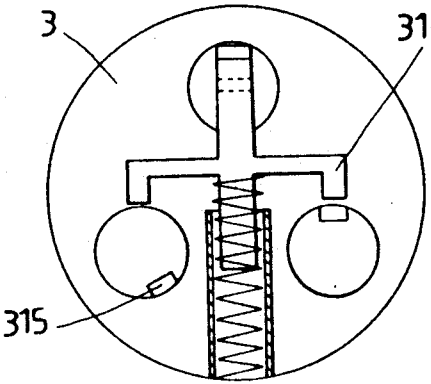
FIG. 8
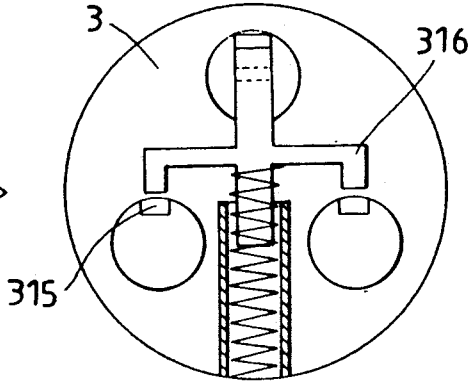
FIG. 9
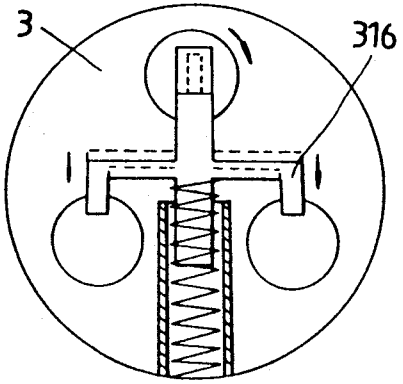
FIG. 10

STRUCTURE OF COMBINED LOCK DEVICE

BACKGROUND OF THE INVENTION

The present invention relates to lock devices and relates more particularly to a combined lock device for fastening a door, strongbox, etc. by means of a key and at least one combination.

Various types of lock devices have been disclosed for fastening a door, strongbox, etc. by means of a key or combination. A pre-set number code for a combination lock may be detected easily by a skilled person. Therefore, a single combination lock does not provide sufficient protection. Further, the lock bolt of either type of conventional lock devices generally has a slope on the front end thereof convenient for inserting in a strike. Because of the design of the slope, a lock bolt may be forced to move back to an unlocking position when a pry is inserted through the gap between the door frame and the door panel to press against the slope of the lock bolt.

SUMMARY OF THE INVENTION

The present invention has been accomplished to eliminate the aforesaid problems. It is therefore an object of the present invention to provide a lock device which is practical for use in a variety of fields to fasten a door, strongbox, vehicle and etc.

It is another object of the present invention to provide a lock device which combines a key lock with at least one combination lock forming into a lock linkage.

It is still another object of the present invention to provide a lock device which combines a key lock with at least one combination lock forming into a lock linkage wherein the number code for the combination lock thereof can be conveniently changed.

It is still another object of the present invention to provide a lock device which has a cover means which can be moved to alternatively conceal the key lock or either combination lock of the lock linkage thereof.

It is a yet further object of the present invention to provide a lock device which has a structure to protect against insertion of a pry.

To achieve the above objects, there is provided a lock device comprised of a key lock linked up with at least one combination lock. A division plate is mounted on the lock device and moved to alternatively conceal the key lock or either combination lock. Because the key lock is linked up with the at least one combination lock, it can be unlocked by a key only when the at least one combination lock has been unlocked. Because of the protection of the division plate, the key lock and the at least one combination lock are not simultaneously exposed to the outside and therefore, no body can use any tool to open the key lock while detecting the number code for the at least one combination lock. The lock bolt which is controlled by the key lock and driven by the key to fasten a door, strongbox, etc. has a notch on the slope of the front end thereof to protect against insertion of a pry.

BRIEF DESCRIPTION OF THE DRAWINGS

FIG. 1 is a dismantled perspective view of a combined lock device constructed according to the present invention;

FIG. 2 is a sectional assembly view of the combined lock device of FIG. 1;

FIG. 3 illustrates that a pry is inserted in the gap in a door to force a conventional lock bolt to move back;

FIG. 4 illustrates a lock bolt according to the present invention which has a notch disposed in alignment with the gap in a door to protect against insertion of a pry;

FIG. 5 illustrates that the division plate is rotated to a first position with the hole thereon aligned with the first combination lock;

FIG. 6 illustrates that the division plate is rotated to a second position with the hole thereon aligned with the second combination lock;

FIG. 7 illustrates that the division plate is rotated to a third position with the hole thereon aligned with the key lock;

FIG. 8 illustrates that the first combination lock is rotated to an unlocking position with the side notch thereof aligned with the sliding bar of the key lock;

FIG. 9 illustrates that the second combination lock is rotated to an unlocking position with the side notch thereof aligned with the sliding bar of the key lock;

FIG. 10 illustrates that the two terminal ends of the sliding bar of the key lock are respectively driven by a key to insert in the side notch of either combination lock;

DETAILED DESCRIPTION OF THE PREFERRED EMBODIMENT

Figure 14:
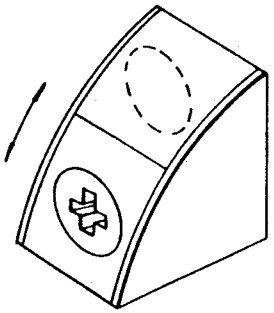
FIG. 14 illustrates another alternate form of the present invention.

Referring to FIGS. 1 and 2, there is shown a combined lock device constructed according to the present invention and generally comprised of a lock body 1, a bottom cap 2, a combined cylinder unit 3, a top cap 4, and a division plate 5. The combined cylinder unit 3 is made inside the lock body 1, comprising a key lock 30 linked up with two combination locks 31 and 32. The key lock 30 has a cross key hole 300 into which a key is inserted to drive a bolt 6 and a sliding bar 316 from an unlocking into a locking position or from a locking into an unlocking position. Each combination lock 31 or 32 is comprised of a number wheel 310 mounted on a locking wheel 311 at the top, wherein the number wheel 310 has a cross hole 313 vertically disposed at the center and a series of numbers 312 marked thereon around said cross hole 313; the locking wheel 311 has a stub rod 314 vertically disposed on the top at the center and fastened in the number wheel 310 permitting the locking wheel 311 to be carried by the number wheel 310 to rotate, a side notch 315 at the bottom into which the sliding bar 316 is inserted, a through-hole 317 vertically disposed at a location opposite to said side notch 315 for fastening a locking pin 318 to set a desired number code. The lock body 1 has a round hole 319 at the center for mounting the division plate 5. The division plate 5 has a stub rod vertically projecting downwards from the bottom surface thereof at the center and inserted in the round hole 319 on the lock body 1, and a hole 50 at an eccentric location. By rotating the division plate 5 on the lock body 1, the hole 50 is alternatively moved to aligned with the key lock 30 or either combination lock 31 or 32. After mounting of the division plate 5 on the lock body 1, the top cap 4 and the bottom cap 2 are respectively attached to the lock body 1. The top cap 4 has a top flange 40 projecting inwards which protects the division plate 5 against insertion of a pry. The bottom cap 2 has a slot 21 through which the bolt 6 is moved to fasten or unfasten a door, strongbox, etc., and an access hole 20 for changing number code.

Referring to FIG. 4, the bolt 6 has a notch 60 on the slope of the front end thereof. When a pry or any harden object is inserted through the gap between any two parts which are fastened together by the lock of the present invention, it will be stuck in the notch 60 and can not force the bolt 6 to move back (in the conventional structure as shown in FIG. 3, pressing a pry against the slope on the front end of the bolt, the bolt will be easily forced to move back into an unlocking position).

Referring to FIGS. 5 through 10, operation of the present invention is outlined hereinafter. Rotate the division plate 5 permitting the hole 50 thereon to be aligned with the first combination lock 31 (see fig. 5), and then, rotate the number wheel of the first combination lock 31 according to pre-set number code permitting the side notch 315 of the first combination lock 31 to be aligned with the sliding bar 316 (see FIG. 8). As soon as the first combination lock 31 is rotated to an unlocking position, the division plate 5 is rotated again permitting the hole 50 thereon to be aligned with the second combination lock 32 (see FIG. 6) and then, rotate the second combination lock 32 according to preset number code permitting the side notch 315 of the second combination lock 32 to be aligned with the sliding bar 316 (see FIG. 9). Then, rotate the division plate 5 again permitting the hole 50 thereon to be aligned with the key lock 30 (see FIG. 7). As soon as the key lock 30 is exposed to the hole 50 on the division plate 5, insert the key for the key lock 30 into the key hole 300 and turn it to an unlocking position to drive the lock bolt 6 to move from a locking position back to an unlocking position. Because the side notch 315 of each combination lock 31 or 32 is aligned with either terminal end of the sliding bar 316, there is sufficient space for the sliding bar 316 to move back and forth (see FIG. 10) and therefore, the key for the key lock 30 is permitted to be rotated to drive the lock bolt 6 from a locking position to an unlocking position so as to unlock a door.

Figure 15:
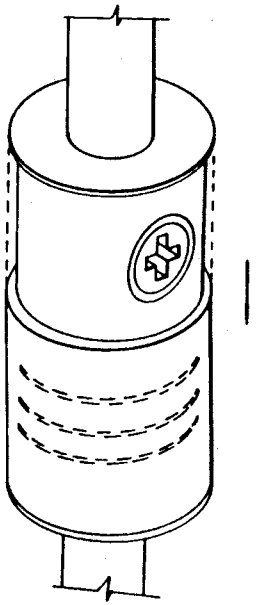
FIG. 15 illustrates a yet further alternate form of the present invention.
Figure 12:
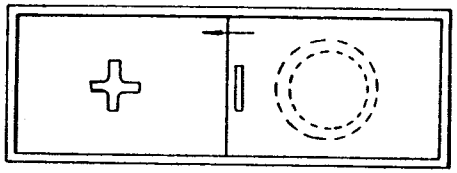
FIGS. 12 and 13 illustrate an alternate form of the present invention.
Figure 13:
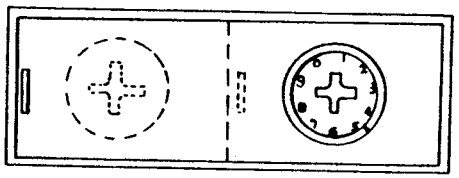
Figure 11:
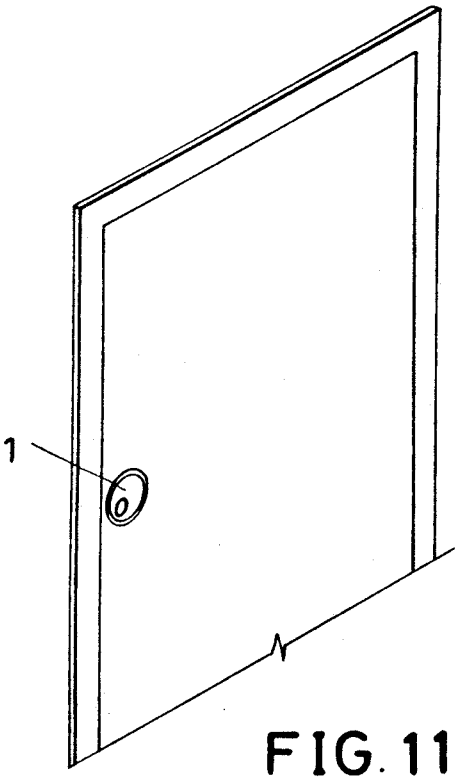
FIG. 11 illustrates that a combined lock device of the present invention is installed in a door panel to fasten a door.

FIG. 11 illustrates an example of the present invention which is fastened in a door panel for fastening a door. FIGS. 12 and 13 illustrate an alternate form of the present invention, in which a key lock and a combination lock are disposed side by side, forming into a combined lock device and, a sliding board is alternatively covered on the key lock or the combination lock. FIG. 14 illustrates another alternate form of the present invention, in which the lock body is designed in a sector-like shape and, a slide plate is arranged to slide above a face to alternatively cover a key lock or a combination lock which are respectively fastened in the face. FIG. 15 illustrates a yet further alternate form of the present invention, in which a key lock is disposed above a combination lock and incorporated therewith into a combined lock device and, a sleeve is alternatively moved to cover the key lock or the combination lock.

I claim:

1. A combined lock device comprising a lock body having fastened therein a combined cylinder unit, a bottom cap attached to said lock body at a bottom, a top cap attached to said lock body at a top to secure a movable division plate covering over said combined cylinder unit, said combined cylinder unit comprised of a key lock cooperating with at least one combination lock, said division plate having a hole thereon, wherein said division plate is moved to carry the hole thereon to be alternatively aligned with said key lock and said at least one combination lock, permitting said key lock to be controlled by a key to drive a lock bolt to move from a locking position to an unlocking position or from said unlocking position to said locking position after said at least one combination lock has been opened.

2. The combined lock device of claim 1, wherein said lock bolt has a notch on a slope of a front end thereof, which notch is disposed at a location aligned with a gap between two objects that are fastened by said lock bolt.

3. The combined lock device of claim 1, wherein said division plate can be designed to be moved either through rotary motion or linear motion so as to carry the hole thereon to be alternatively aligned with said key lock and said at least one combination lock.

* * * * *